US007022657B2

(12) United States Patent
Hines et al.

(10) Patent No.: US 7,022,657 B2
(45) Date of Patent: Apr. 4, 2006

(54) GEL LAUNDRY DETERGENT COMPOSITION

(75) Inventors: John David Hines, Wirral (GB); Feng-Lung Gordon Hsu, Edgewater, NJ (US); Yun-Peng Zhu, Edgewater, NJ (US)

(73) Assignee: Unilever Home and Personal Care USA division of Conopco, Inc., Greenwich, CT (US)

( * ) Notice: Subject to any disclaimer, the term of this patent is extended or adjusted under 35 U.S.C. 154(b) by 71 days.

(21) Appl. No.: 10/702,231

(22) Filed: Nov. 6, 2003

(65) Prior Publication Data

US 2004/0142846 A1 Jul. 22, 2004

(30) Foreign Application Priority Data

Nov. 6, 2002 (EP) ..... 02257682

(51) Int. Cl.
*C11D 17/00* (2006.01)

(52) U.S. Cl. ..... 510/407; 510/417; 510/424; 510/426; 510/505

(58) Field of Classification Search ..... 510/407, 510/417, 424, 426, 505, 506
See application file for complete search history.

(56) References Cited

U.S. PATENT DOCUMENTS

| | | | | |
|---|---|---|---|---|
| 5,281,355 | A | 1/1994 | Tsaur et al. | 252/174.13 |
| 5,820,695 | A | 10/1998 | Lance-Gomez et al. | 134/42 |
| 5,952,286 | A | 9/1999 | Puvvada et al. | 510/417 |
| 6,362,156 | B1 | 3/2002 | Hsu et al. | 510/418 |
| 2002/0010111 | A1 | 1/2002 | Mitra | 510/130 |

FOREIGN PATENT DOCUMENTS

| | | |
|---|---|---|
| DE | 100 61 416 | 6/2002 |
| GB | 1 308 190 | 2/1973 |
| WO | 99/27065 | 6/1999 |

OTHER PUBLICATIONS

European Search Report in an EP application EP 02 25 7682.
Derwent Abstract of DE 100 61 416 published Jun. 20, 2002.
Co-pending U.S. Appl. No. 10/251,738, filed Sep. 20, 2002, Zhu et al.
Co-pending U.S. Appl. No. 10/251,481, filed Sep. 20, 2002, Hsu et al.
Co-pending U.S. Appl. No. 10/251,458, filed Sep. 20, 2002, Hsu et al.
Co-pending U.S. Appl. No. 10/247,957, filed Sep. 20, 2002, Hsu et al.
Co-pending U.S. Appl. No. 10/694,980, filed Oct. 28, 2003, Hsu et al.

*Primary Examiner*—Necholus Ogden
(74) *Attorney, Agent, or Firm*—Rimma Mitelman

(57) ABSTRACT

The present invention provides a shear thinning, transparent, gel laundry detergent composition, comprising a surfactant system containing surfactant material selected from an anionic surfactant, a nonionic surfactant or a mixture thereof, and from 1 to 8% by weight of a fatty alcohol gelling agent having the formula

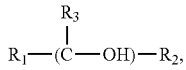

wherein R1, R2 and R3 are independently selected from hydrogen and saturated or unsaturated, linear or branched $C_1$–$C_{16}$ alkyl groups, whereby the total number of carbon atoms in the gelling agent is between 8 and 17. It has been found that this gel laundry composition can stable suspend particles or capsules either for improving visual appearance or for practical reasons.

13 Claims, No Drawings

GEL LAUNDRY DETERGENT COMPOSITION

FIELD OF THE INVENTION

The present invention relates to stable gel laundry detergent compositions. In particular, the invention relates to stable, shear thinning heavy-duty gel laundry detergent compositions comprising anionic and nonionic surfactant material.

BACKGROUND OF THE INVENTION

For a variety of reasons, it is often greatly desirable to suspend particles in liquid detergent compositions. For example, because there are certain components (e.g. bleaches, enzymes, perfumes) which readily degrade in the hostile environment of surfactant-containing detergent liquids, these components are often protected in capsule-type particles (see, for example, U.S. Pat. No. 5,281,355) and these capsule-type particles may be suspended in liquid detergent compositions. Other components which may be protected and suspended in this way are, for instance, polyvinylpyrrolidone, aminosilicones, soil release agents and antiredeposition agents. Such particles may vary significantly in size but, usually, their size is in the range of from 300 to 5000 micrometers.

Furthermore, when the liquid detergent composition is translucent or transparent, it may be desirable to suspend coloured particles or capsules of similar size in said liquid composition so as to improve the visual appearance thereof.

Shear thinning gel-type detergent compositions are generally suitable for stable suspending particles therein, since they usually have adequate viscosity when in rest or under very low shear. On the other hand, owing to their shear thinning properties, such gel-type compositions have much lower viscosity when under pouring shear.

One way of formulating such gel-type detergents is by changing a non-gelled formulation so as to form an internal structure therein which structure gives the desired properties to the thus-formed gel-type detergent.

WO-A-99/27065, WO-A-99/06519 and U.S. Pat. No. 5,820,695 disclose gel-type laundry detergent compositions having an internal structure. These documents teach systems wherein soap or fatty acid in combination with sodium sulphate and a rather specific surfactant system are used to form a gelled structure by the formation of lamellar phases.

Alternatively, shear thinning gel-type detergent compositions may be formulated by adding specific ingredients to a non-gelled detergent formulation, typically at low dosage, so as to induce gellation.

Examples of this route for preparing gelled detergents are disclosed in U.S. Pat. No. 6,362,156. More specifically, this document discloses shear thinning, transparent gel-type laundry compositions comprising a polymer gum, such as Xanthan gum, which gum is capable of forming stable continuous gum networks which can suspend particles.

However, when using a polymer additive such as the polymer gum disclosed in U.S. Pat. No. 6,362,156, so as to form the gelling structure, it is generally required to carry out several specific steps in the manufacturing process in order that the gel structure is properly formed. These steps are relatively costly and make the manufacturing process rather time-consuming.

Furthermore, while it is possible to suspend particles or capsules in a formulation disclosed by U.S. Pat. No. 6,362,156, this was found to be not straightforward: the need to suspend particles therein may give rise to significant additional restrictions on formulation flexibility. Gels structured by polymer often exhibit syneresis leading to a net movement of suspended matter, which phenomenon can only be avoided by careful choice of ingredients.

Alternatively, U.S. Pat. No. 5,952,286 discloses skin cleansing compositions comprising lamellar phase dispersions from rad micellar surfactant systems, and additionally a structurant for establishing the lamellar phase, whereby said structurant may be a fatty alcohol.

In view of the foregoing, it is an object of the present invention to find a shear thinning gel detergent formulation which does not show the above-described drawbacks.

It is another object of the invention to provide a shear thinning gel detergent formulation that is transparent and can stably suspend particles or capsules either for improving visual appearance or for practical reasons.

It is a further object to provide a shear thinning gel detergent formulation that has favourable cleaning efficacy. It has been surprisingly found that these objects could be achieved with the shear thinning gel laundry detergent composition of the present invention, containing relatively small amounts of fatty alcohol, as specified in claim 1.

Without wishing to be bound by theory, it is believed that the fatty alcohol interacts with aggregates present in the composition of the invention so as to promote the formation of planar lamellar structures similar to those found in internally structured detergent gels as e.g. disclosed by WO-A-99/27065.

DEFINITION OF THE INVENTION

Accordingly, the present invention provides a shear thinning, transparent, gel laundry detergent composition comprising a surfactant system containing surfactant material selected from an anionic surfactant, a nonionic surfactant and a mixture thereof, and from 1 to 8% by weight of a fatty alcohol gelling agent having the formula (I)

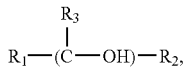

(I)

wherein:

R1, R2 and R3 are independently selected from hydrogen and saturated or unsaturated, linear or branched $C_1$–$C_{16}$ alkyl groups, whereby the total number of carbon atoms in the gelling agent is between 8 and 17.

The present invention is also concerned with the use of a fatty alcohol as a gelling agent in a gel laundry detergent composition of the invention.

DETAILED DESCRIPTION OF THE INVENTION

In general, the gel laundry detergent composition of the invention is relatively viscous, and has preferably a viscosity of at least 100 Pa.s, more preferably at least 500 Pa.s, when in rest or up to a shear stress of 10 Pa.

As a consequence, the composition of the invention is very suitable for stably suspending relatively large particles, such as those having a size of from 300 to 5000 microns.

Furthermore, syneresis leading to a net migration of suspended matter has never been observed in the gel composition of the invention. Preferably, the composition of the invention contains 0.1 to 10% by weight of suspended particles having a size within the range mentioned above.

On the other hand, the shear thinning properties of the gel laundry detergent composition of the invention are such that its viscosity under a shear stress of 300 Pa, preferably 100 Pa, or greater, is at most 5 Pa.s, preferably at most 1 Pa.s, more preferably at most 0.5 Pa.s.

The shear thinning behaviour of the gel composition of the invention ensures that it can be easily poured. Furthermore, a micro-emulsion is desirably not present in said gel composition.

The gel detergent composition of the invention is also stable, which means that it does not phase separate when stored for at least 2 weeks at room temperature.

Furthermore, said gel detergent composition is transparent, such that particles can be suspended therein, for improving visual appearance. By "transparent", it is meant that light is easily transmitted through the composition of the invention and that objects on one side of the gel composition are at least partially visible from the other side of the composition.

Alternatively, the transparency of the gel detergent composition is defined in that said composition has at least 50% transmittance of light using a 1 centimeter cuvette at a wavelength of 410–800 microns, preferably 570–690 microns, whereby the composition is measured in the absence of dyes. The gel composition of the invention is also preferably an aqueous composition having a free water concentration of more than 25%, more preferably more than 50% by weight.

Furthermore, the surfactant system contained in the gel laundry composition of the present invention is preferably substantially free of any amphoteric or zwitterionic surfactant.

The Fatty Alcohol Gelling Agent

The total number of carbon atoms in the fatty alcohol gelling agent according to the present invention is preferably between 10 and 14.

Furthermore, very suitable gelling agents of the invention are fatty alcohols having the formula (II)

$$R_1—(CHOH)—R_2 \quad (II),$$

wherein:

R1, R2 are independently selected from hydrogen and saturated or unsaturated, linear or branched $C_1$–$C_{16}$ alkyl groups, whereby the total number of carbon atoms in the gelling agent is between 8 and 17.

More preferably, fatty alcohols having formula (II) are applied, wherein $R_1$ is hydrogen, and $R_2$ is selected from saturated, linear or branched $C_9$–$C_{13}$ alkyl groups.

Favourable results could generally be obtained when applying as gelling agent a fatty alcohol in which the total chain length is similar to the average chain length of the surfactants present in the formulation. Such a gelling agent is preferably selected from the group consisting of 1-decanol, 1-dodecanol, 2-decanol, 2-dodecanol, 2-methyl-1-decanol, 2-methyl-1-dodecanol, 2-ethyl-1-decanol, and mixtures thereof.

Commercially available materials that are particularly suitable for use as gelling agent include Neodol 23 or Neodol 25 produced by Shell Chemical Co., Exxal 12 or Exxal 13 produced by Exxonmobil Chemical Co. and Isalchem 123 or Lialchem 123 produced by Sasol Chemical Co.

The concentration of the fatty alcohol gelling agent in the composition of the invention is preferably from 3 to 6% by weight, more preferably from 4 to 5% by weight. Such relatively low amounts were observed to be quite sufficient for obtaining a stable gel composition showing favourable behaviour.

Anionic Surfactant

The anionic surfactant that may be present in the gel composition of the invention is preferably selected from the group consisting of linear alkyl benzene sulphonates, alkyl sulphonates, alkylpolyether sulphates, alkyl sulphates and mixtures thereof.

The linear alkyl benzene sulphonate (LAS) materials and their preparation are described for example in U.S. Pat. Nos. 2,220,099 and 2,477,383, incorporated herein by reference. Particularly preferred are the sodium, potassium and mono-, di-,or tri-ethanolamminium linear straight chain alkylbenzene sulphonates in which the average number of carbon atoms in the alkyl group is from 11 to 14. Sodium salt of C11–C14, e.g. C12, LAS is especially preferred.

Preferred anionic surfactants also include the alkyl sulphate surfactants being water soluble salts or acids of the formula ROSO3M, wherein R preferably is a C10–C24 hydrocarbyl, preferably an alkyl or hydroxyalkyl having a C10–C18 alkyl group, more preferably a C12–C15 alkyl or hydroxyalkyl, and wherein M is H or a cation, e.g. an alkali metal cation (e.g. sodium, potassium, lithium), or ammonium or substituted ammonium, especially mono-, di-, or tri-ethanolammonium. Most preferably, M is sodium.

Further preferred anionic surfactants are alkyl sulphonates, and desirably those in which the alkyl groups contain 8 to 26 carbon atoms, preferably 12 to 22 carbon atoms, and more preferably 14 to 18 carbon atoms.

The alkyl substituent is preferably linear, i.e. normal alkyl, however, branched chain alkyl sulphonates can be employed, although they are not as good with respect to biodegradability. The alkyl substituent may also be terminally sulphonated or may be joined to any carbon atom on the alkyl chain, i.e. may be a secondary sulphonate. The alkyl sulphonates can be used as the alkali metal salts, such as sodium and potassium. The preferred salts are the sodium salts. The preferred alkyl sulphonates are the C10 to C18 primary normal alkyl sodium sulphonates.

Also, alkyl polyether sulphates are preferred anionic surfactants for use in the composition of the invention. These polyether sulphatesmay be normal or branched chain alkyl and contain lower alkoxy groups which can contain two or three carbon atoms. The normal alkyl polyether sulphates are preferred in that they have a higher degree of biodegradability than the branched chain alkyl, and the alkoxy groups are preferably alkoxy groups.

The preferred alkyl polyethoxy sulphates used in accordance with the present invention are represented by the formula:

$$R_1—O(CH_2CH_2O)p\ -SO_3M,$$

wherein:

$R_1$ is $C_8$ to $C_{20}$ alkyl, preferably $C_{12}$ to $C_{15}$ alkyl;

p is 2 to 8, preferably 2 to 6, and more preferably 2 to 4; and M is an alkali metal, such as sodium and potassium, or an ammonium cation. The sodium salt is preferred.

The surfactant system of the invention may additionally contain fatty acids or fatty acid soaps.

The fatty acids include saturated and non-saturated fatty acids obtained from natural sources and synthetically prepared. Examples of fatty acids include capric, lauric, myristic, palmitic, stearic, oleic, linoleic and linolenic acid.

The concentration of the anionic surfactant in the gel composition of the invention is preferably in the range of from 5 to 50%, more preferably from 5 to 25% by weight. The anionic surfactant material may be incorporated in free and/or neutralised form.

Nonionic Surfactant

The surfactant system in the gel composition of the invention may also contain a nonionic surfactant.

Nonionic detergent surfactants are well-known in the art. They normally consist of a water-solubilizing polyalkoxylene or a mono- or d-alkanolamide group in chemical combination with an organic hydrophobic group derived, for example, from alkylphenols in which the alkyl group contains from about 6 to about 12 carbon atoms, dialkylphenols in which primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylene. Also common are fatty acid mono- and dialkanolamides in which the alkyl group of the fatty acidradical contains from 10 to about 20 carbon atoms and the alkyloyl group having from 1 to 3 carbon atoms.

In any of the mono- and di-alkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in European specification EP-A-225,654. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide.

The nonionic surfactant is preferably present in the gel composition of the invention at a concentration of from 5 to 50% by weight, more preferably from 5 to 30% by weight.

Builders

Builders which can be used according to the present invention include conventional alkaline detergent builders, inorganic or organic, which can be used at levels of from 0% to 50% by weight of the gel composition, preferably from 1% to 35% by weight.

Examples of suitable inorganic detergency builders that may be used are water soluble alkali metal phosphates, polyphosphates, borates, silicates, and also carbonates. Specific examples of such builders are sodium and potassium triphosphates, pyrophosphates, orthophosphates, hexametaphosphates, tetraborates, silicates, and carbonates.

Examples of suitable organic detergency builders are: (1) water-soluble amino polycarboxylates, e.g. sodium and potassium ethylenediaminetetraacetates, nitrilotriacetates and N-(2 hydroxyethyl)-nitrilodiacetates; (2) water-soluble salts of phytic acid, e.g. sodium and potassium phytates; (3) water-soluble polyphosphonates, including specifically sodium and potassium salts of ethane-1-hydroxy-1,1-diphosphonic acid; sodium and potassium salts of methylene diphosphonic acid; sodium and potassium salts of ethylene diphosphonic acid; and sodium and potassium salts of ethane-1,1,2-triphosphonic acid.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, and tartrate disuccinate.

Desirably, the detergency builder is selected from the group consisting of carboxylates, polycarboxylates, aminocarboxylates, carbonates, bicarbonates, phosphates, phosphonates and mixtures thereof.

Alkalimetal (i.e. sodium or potassium) citrate is most preferred builder material for use in the invention.

Amorphous and crystalline zeolites or aluminosilicates can also be suitably used as detergency builder in the gel composition of the invention.

Enzymes

Suitable enzymes for use in the present invention include proteases, amylases, lipases, cellulases, peroxidases, and mixtures thereof, of any suitable origin, such as vegetable, animal bacterial, fungal and yeast origin. Preferred selections are influenced by factors such as pH-activity, thermostability, and stability to active bleach detergents, builders and the like. In this respect bacterial and fungal enzymes are preferred such as bacterial proteases and fungal cellulases. Enzymes are normally incorporated into detergent composition at levels sufficient to provide a "cleaning-effective amount". The term "cleaning effective amount" refers to any amount capable of producing a cleaning, stain removal, soil removal, whitening, or freshness improving effect on the treated substrate. In practical terms for normal commercial operations, typical amounts are up to about 5 mg by weight, more typically 0.01 mg to 3 mg, of active enzyme per gram of detergent composition. Stated otherwise, the composition of the invention may typically comprise from 0.001 to 5%, preferably from 0.01 to 1% by weight of a commercial enzyme preparation.

Protease enzymes are usually present in such commercial preparations at levels sufficient to provide from 0.005 to 0.1 Anson units (AU) of activity per gram of composition. Higher active levels may be desirable in highly concentrated detergent formulations.

Suitable examples of proteases are the subtilisins that are obtained from particular strains of *B. subtilis* and *B.licheniformis*. One suitable protease is obtained from a strain of *Bacillis*, having maximum activity throughout the pH-range of 8–12, developed and sold as ESPERASE ® by Novo Industries A/S of Denmark.

Other suitable proteases include ALCALASE ® and SAVINASE ® from Novo and MAXATASE ® from International Bio-Synthetics, Inc., The Netherlands.

Suitable lipase enzymes for use in the composition of the invention include those produced by microorganisms of the *Pseudomonas* group, such as *Pseudomonas stutzeri* ATCC 19.154, as disclosed in GB-1,372,034. A very suitable lipase enzyme is the lipase derived from *humicola lanuginosa* and available from Novo Nordisk under the tradename LIPOLASE ™.

Other Optional Components

In addition to the anionic and nonionic surfactants described above, the surfactant system of the invention may optionally contain a cationic surfactant.

Furthermore, alkaline buffers may be added to the compositions of the invention, including monethanolamine, triethanolamine, borax, and the like.

As another optional ingredient, an organic solvent may suitably be present in the gel composition of the invention, preferably at a concentration of up to 10% by weight.

There may also be included in the formulation, minor amounts of soil suspending or anti-redeposition agents, e.g.

polyvinyl alcohol, fatty amides, sodium carboxymethyl cellulose or hydroxy-propyl methyl cellulose.

Optical brighteners for cotton, polyamide and polyester fabrics, and anti-foam agents, such as silicone oils or silicone oil emulsions, may also be used.

Other optional ingredients which may be added in minor amounts, are soil release polymers, dye transfer inhibitors, polymeric dispersing agents, suds suppressors, dyes, perfumes, colourants, filler salts, antifading agents and mixtures thereof.

The invention will now be illustrated with reference to the following example, in which parts and percentages are by weight.

EXAMPLE 1

The following gel laundry detergent compositions were prepared, of which composition A is according to the invention and composition B is a comparative composition according to the prior art:

| | Wt % | |
|---|---|---|
| Component: | A | B |
| Propylene glycol | 8.0 | 8.0 |
| sodium citrate | 3.9 | 3.9 |
| Borax | 3.0 | 3.0 |
| NaOH (50%) | 1.1 | 1.1 |
| Monoethanolamine | 1.0 | 1.0 |
| LAS-acid | 4.4 | 4.4 |
| Coconut fatty acid | 1.5 | 1.5 |
| Nonionic surfactant | 11.1 | 11.1 |
| Oleic acid | 2.3 | 2.3 |
| 1-Dodecanol | 5.0 | 0.0 |
| Protease enzyme | 0.3 | 0.3 |
| Lipase enzyme | 0.5 | 0.5 |
| Perfume | 0.2 | 0.2 |
| Water | balance to 100 | balance to 100 |

wherein:
Borax: Sodium tetraborate (10aq)
nonionic surfactant: ethoxylated alcohol with on average 9 ethylene oxide groups.

The gel detergent composition exemplified by composition A was found to be shear thinning and stable. Furthermore, typical detergent particles of density between 0.8 and 0.9 g/cm3 and having a diameter up to 5000 microns could be stable suspended in this composition for more than 2 weeks without any observable net movement of the particles.

The non-gelled comparative detergent composition exemplified by composition B differed from composition A only in the absence of the fatty alcohol (i.e. 1-dodecanol). Composition B was found to be a clear, stable, Newtonian isotropic liquid. Critical rheological properties of the two are given below

| | Viscosity/Pa · s | | Eta 0 | Critical Stress | Tan Delta |
|---|---|---|---|---|---|
| Sample | 20 s − 1 | 100 s − 1 | Pa · s | Pa | at 1 Hz |
| A | 2.11 | 0.61 | 3.00E+05 | 15 | 0.04 |
| B | 0.88 | 0.86 | 0.89 | 0.001 | 57 |

For obtaining the values shown in the above table, all rheological measurements were carried out at 25° C. using a Carrimed CSL100 rheometer with a cone and plate geometry specially roughed to prevent slip.

Viscosity was measured at varying shear rates from very low shear up to a shear regime in excess of 100 $s^{-1}$. Two situations are shown: the viscosity measured at relatively low shear (20 $s^{-1}$) and that measured at much higher shear (100 $s^{-1}$). It can be seen that the viscosity of composition A at high shear is much lower than that obtained at low shear, whereas composition B shows almost equal viscosity's for high and low shear. In other words composition A is clearly shear thinning, whereas composition B is not.

In addition, the critical stress is shown. This parameter represents the stress at which the material leaves the upper Newtonian plateau and thins under increasing shear. Also, "Eta 0"-values are shown, referring to the viscosity calculated for zero shear from creep flow measurements.

Finally, "Tan delta" values are shown, referring to the ratio of loss over storage moduli (G"/G') and reflecting the dominance of viscous over elastic properties such that materials giving very low "Tan delta"-values (tending to zero, such as composition A in the above table), will be much more elastic than those giving higher "Tan delta" values (tending to 90).

EXAMPLE 2

The following gel laundry detergent compositions were prepared of which composition C is according to the invention and composition D is a comparative composition according to the prior art:

| | Wt % | |
|---|---|---|
| Component: | C | D |
| Propylene glycol | 4.75 | 4.75 |
| sodium citrate | 2.8 | 2.8 |
| Borax | 2.3 | 2.3 |
| NaOH (50%) | 0.43 | 0.43 |
| Monoethanolamine | 0.23 | 0.23 |
| LAS-acid | 6.0 | 6.0 |
| Coconut fatty acid | 0.77 | 0.77 |
| Sodium alcohol EO sulphate | 10.5 | 10.5 |
| Nonionic surfactant | 6.6 | 6.6 |
| 1-Decanol | 6.0 | 0.0 |
| Protease enzyme | 0.45 | 0.45 |
| Lipase enzyme | 0.25 | 0.25 |
| Perfume | 0.2 | 0.2 |
| Water | balance to 100 | balance to 100 |

wherein:
Borax: Sodium tetraborate (10aq)
nonionic surfactant: ethoxylated alcohol with on average 9 ethylene oxide groups
Sodium alcohol EO sulphate: ethoxylated alcohol sulphate with on average 3 ethylene oxide groups.

As in example 1, the two compositions, C and D, shown above differ only in that composition C contains 6% fatty alcohol (1-Decanol) and composition D does not. Composition C was found to be a stable, transparent, pourable shear thinning gel while composition D was found to be a stable, clear, Newtonian isotropic liquid. Composition C was furthermore found to be capable of stable suspending typical detergent particles having a density of between 0.8 and 0.9 g/cm3 and a diameter of up to 5000 microns, for more than 2 weeks without any observable net movement of the particles.

Critical rheological parameters for the two compositions are shown below.

| | Viscosity/Pa · s | | Eta 0 | Critical Stress | Tan Delta |
|---|---|---|---|---|---|
| Sample | 20 s − 1 | 100 s − 1 | Pa · s | Pa | at 1 Hz |
| C | 1.33 | 0.48 | 9.85E+05 | 10 | 0.07 |
| D | 0.29 | 0.29 | 0.29 | 0.001 | 57 |

For clarification of the rheological values shown in this table, reference is made to the description concerning the similar table shown in above example 1.

The invention claimed is:

1. A shear thinning, transparent, gel laundry detergent composition free of microemulsion, comprising a surfactant system containing surfactant material selected from an anionic surfactant, a nonionic surfactant or a mixture thereof, additional laundry detergent composition ingredient selected from the group consisting of enzyme, builder, optical brightener, soil release polymer, and mixtures thereof, and from 1 to 8% by weight of a fatty alcohol gelling agent having the formula

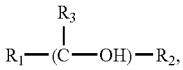

(I)

wherein:

R1, R2 and R3 are independently selected from hydrogen and saturated or unsaturated, linear or branched $C_1$–$C_{16}$ alkyl groups, whereby the total number of carbon atoms in the gelling agent is between 8 and 17; wherein said composition comprises an anionic surfactant in an amount from 5 to 50% by weight and has a viscosity of at least 100 Pa.s.

2. A composition according to claim 1, wherein the fatty alcohol gelling agent has the formula

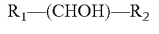

(II), wherein:

R1 is hydrogen, and

R2 is selected from saturated, linear or branched $C_9$–$C_{13}$ alkyl groups.

3. A composition according to claim 2, wherein the fatty alcohol gelling agent is chosen from 1-decanol, 1-dodecanol, 2-decanol, 2-dodecanol, 2-methyl-1-decanol, 2-methyl-1-dodecanol, 2-ethyl-1-decanol and mixtures thereof.

4. A composition according to claim 1, wherein the concentration of the fatty alcohol gelling agent in the composition is from 3 to 6% by weight.

5. A composition according to claim 1, wherein the surfactant system contains an anionic surfactant selected from the group consisting of linear alkyl benzene sulphonate, alkyl sulphonate, alkylpolyether sulphate, alkyl sulphate and mixtures thereof.

6. A composition according to claim 1, wherein the anionic surfactant is present at a concentration of from 5% to 50% by weight, preferably from 5% to 25% by weight.

7. A composition according to claim 1, wherein the nonionic surfactant is an ethoxylated alcohol having 3 to 11 ethylene oxide groups.

8. A composition according to claim 1, wherein the nonionic surfactant is present at a concentration of from 5% to 50% by weight, preferably from 5% to 30% by weight.

9. A composition according to claim 1, wherein the composition additionally comprises a detergency builder selected from the group consisting of carboxylates, polycarboxylates, aminocarboxylates, carbonates, bicarbonates, phosphates, phosphonates and mixtures thereof.

10. A composition according to claim 9, wherein the detergent builder is alkali metal citrate.

11. A composition according to claim 1, wherein the composition further comprises up to 10% by weight of an organic solvent.

12. A composition according to claim 1, wherein the composition further comprises minor ingredients selected from the group consisting of optical brighteners, alkaline buffers, soil release polymers, dy transfer inhibitors, polymeric dispersing agents, suds suppressors, dyes, perfumes, colourants, filler salts antiredeposition agents, antifading agents and mixtures thereof.

13. A composition according to claim 1, wherein the composition comprises 0.1 to 10% by weight of particles having a size of from 300 to 5000 microns.

* * * * *